US005948234A

United States Patent [19]

Kinard et al.

[11] Patent Number: 5,948,234

[45] Date of Patent: Sep. 7, 1999

[54] POLYANILINE SOLUTIONS WITH BICYCLIC TERPENE SOLVENT

[75] Inventors: John T. Kinard, Simpsonville; Brian J. Melody, Greenville; Philip M. Lessner, Simpsonville, all of S.C.

[73] Assignee: Kemet Electronics Corporation, Greenville, S.C.

[21] Appl. No.: 09/220,759

[22] Filed: Dec. 28, 1998

Related U.S. Application Data

[62] Division of application No. 08/987,207, Dec. 9, 1997, Pat. No. 5,888,582.

[51] Int. Cl.[6] ..... C23C 28/00; B21F 41/00

[52] U.S. Cl. ..... 205/200; 205/198; 205/199; 29/25.03

[58] Field of Search ..... 205/198, 199, 205/200; 252/500; 29/25.03

[56] References Cited

U.S. PATENT DOCUMENTS

| | | | |
|---|---|---|---|
| 3,796,644 | 3/1974 | Bernard | 204/58 |
| 5,069,820 | 12/1991 | Jen et al. | 252/500 |
| 5,160,457 | 11/1992 | Elsenbaumer | 252/500 |
| 5,324,453 | 6/1994 | Cao et al. | 252/500 |
| 5,324,815 | 6/1994 | Ohtani et al. | 528/422 |
| 5,378,403 | 1/1995 | Shacklette | 252/500 |
| 5,482,563 | 1/1996 | Pfahl, Jr. et al. | 134/11 |
| 5,556,518 | 9/1996 | Kinlen et al. | 204/484 |
| 5,567,356 | 10/1996 | Kinlen | 252/500 |
| 5,665,170 | 9/1997 | Lee et al. | 134/19 |

FOREIGN PATENT DOCUMENTS

| | | |
|---|---|---|
| 0 797 218 | 9/1997 | European Pat. Off. . |
| 93/15510 | 8/1993 | WIPO . |

*Primary Examiner*—Kathryn Gorgos
*Assistant Examiner*—Edna Wong
*Attorney, Agent, or Firm*—Banner & Witcoff, Ltd.

[57] ABSTRACT

Acid-doped, polyaniline-based polymers are formed into fibers, films, and coatings with a solvent of at least one bicyclic terpene. Such a solvent system is characterized by a drying temperature of less than 150° C. and a relatively low toxicity.

19 Claims, No Drawings

POLYANILINE SOLUTIONS WITH BICYCLIC TERPENE SOLVENT

This application is a divisional of Ser. No. 08/987,207, filed Dec. 9, 1997, now U.S. Pat. No. 5,888,582.

FIELD OF THE INVENTION

The invention relates to doped polyaniline solutions, solvent systems used therein, and conductive articles formed therefrom.

BACKGROUND OF THE INVENTION

Acid-doped polyaniline is finding an increasing level of interest as a solid electrolyte for capacitors and other electronics devices. The dopants are selected from a relatively small group of acids that enhance solubility in organic solvents with a low dielectric constant, e.g., a dielectric constant of less than about 17. Acid-doped polyaniline polymers are generally considered to have no practical solubility in solvents with a dielectric constant of greater than about 17. See U.S. Pat. No. 5,567,356. The most preferred polyaniline dopant is dinonyl naphthalene sulfonic acid (DNSA).

A commercially available solution contains DNSA-doped polyaniline in a solvent mixture containing xylene, ethylene glycol monobutyl ether. Unfortunately, this solvent system is characterized by toxicity and a suggested drying temperature of 150°–200° C. to remove the solvent from the acid-doped polymer. This high temperature is required to remove the xylene-based solvent from relatively porous surfaces as well as thin layers.

It would be useful to have a solvent system that exhibited low toxicity and a lower drying temperature than with xylene-based solvent systems.

It would be even more beneficial to have a solvent system that also had a relatively high boiling point. The higher boiling point would facilitate the use and handling of the solvent in a commercial setting.

Enhanced systems for forming polyaniline-based polymer films and coatings would be particularly useful in the manufacture of capacitors. In such articles, one or more coatings of electrically conductive polyaniline-based polymer can be used as a solid electrolyte between the dielectric oxide layer and the electrodes. It would be useful to have a polyaniline-based polymer dissolution system that did not pose the problems and limitations of the former xylene solvent systems.

SUMMARY OF THE INVENTION

It is an objective of the invention to provide a process for depositing a coating or film of polyaniline from a solution that uses a solvent characterized by a lower drying temperature than xylene-based solvent systems used previously.

In accordance with this and other objectives of the invention that will become apparent from the description herein, a process, coating, and coated article according to the invention are based on the use of a solvent system that use one or more bicyclic terpenes as a solvent for acid-doped polyaniline polymers. This solvent is characterized by lower drying temperatures (e.g., 140° C. or less), good wetting of most surfaces and porous objects, and a lower toxicity than xylene-based solvents previously used for acid-doped polyaniline polymers. The preferred solvent is sold under the common name of gum turpentine and is made primarily from α-pinene and β-pinene.

DETAILED DESCRIPTION

Acid-doped polyaniline-based polymer is dissolved in a solvent containing one or more bicyclic terpenes and used to form conductive articles. Such articles include fibers, films, coatings (particularly coatings for dissipating static electricity), coated articles, batteries, electrolytic sensors, and capacitive elements. One coated article of particular interest is a capacitive element that uses an acid-doped polyaniline-based polymer as a solid electrolyte. The anode body of such a capacitor is preferably made of a valve metal like aluminum or tantalum, with tantalum being generally more preferred between the two.

The polyaniline-based polymers applicable for the present invention are generally described in U.S. Pat. No. 5,069,820 the disclosure of which is herein incorporated by reference. The '820 patent describes electrically conductive, polyaniline-based polymers having the following general formula:

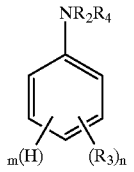

wherein:

n is an integer from 0 to 5;

m is an integer from 0 to 5 with the proviso that the sum of n and m is equal to 5;

R2 and R4 are the same or different and are hydrogen or alkyl of 1–10 carbon atoms;

R3 is the same or different and is selected from alkyl, alkenyl, alkoxy, cycloalkoxy, cycloalkenyl, alkanoyl, alkylthio; alkylamino, aryloxy, alkylthioalkyl, alkylaryl, arylalkyl, amino, dialkylamino, aryl, aryloxyalkyl, alkylsulfinylalkyl, alkylsulfonyl, arylsulfonyl, carboxylic acid, halogen, cyano, sulfonic acid, nitro, alkylsilane, or alkyl substituted with one or more of sulfonic acid, carboxylic acid, halo, nitro, cyano, or epoxy moieties; or any two R3 groups taken together may form an alkylene or alkylene chain completing a 3, 4, 5, 6, or 7-membered aromatic or acyclic ring that may include one or more divalent nitrogen, sulfur, sulfinyl, ester, carbonyl, sulfonyl, or oxygen atoms; R3 is an aliphatic moiety having repeat units of either of the formula:

$$—(OCH_2CH_2)_qO— \text{ or } —(OCH_2CH(CH_3))_qO—$$

wherein q is a positive whole number.

The acid dopants used for the polyaniline-based polymers are generally selected from anions of sulfonic acids (e.g., dinonyl naphthalene sulfonic acid (DNSA), toluenesulfonic acid, dodecylbenzene sulfonic acid, camphor sulfonic acid, allylsulfonic acid, 1-propanesulfonic acid, 1-butananesulfonic acid, 1-hexanesulfonic acid, 1-heptanesulfonic acid, benzenesulfonic acid, styrenesulfonic acid, naphthalenesulfonic acid, including homologs and analogs thereof), and carboxylic acids (e.g., acetic acid and oxalic acid). The preferred organic sulfonic acid dopants includes toluenesulfonic acid, dodecylbenzene sulfonic acid, and camphor sulfonic acid.

The primary solvent for the present invention is characterized by a composition containing one or more bicyclic terpenes. The preferred solvent includes gum turpentine and owes its solvation effects due to the chemical relationship between that liquid and the acid-doped polyaniline polymer. If desired, the solvent may contain only gum turpentine to the exclusion of all other materials but for minor impurities or other agents that do not materially affect the solvation effects of the turpentine on the polyaniline polymer solids. Most preferably, the beneficial effects of the solvents for the present invention are characterized by a drying temperature of 140° C. or less. Particularly preferred are solvent compositions that require a drying temperature of 120° C. or less with those solvents that need a temperature of 100° C. or less being especially desirable. Applied vacuum can be used to facilitate removal of the solvent.

The solvent of the invention allows polyaniline-based polymer solutions to be made at a variety of concentrations from 0.01–35 wt % with stirring and heating of 80°–85° C. at the higher concentrations. The more commercially useful concentrations for thorough impregnation and coating of porous substrates is a solution having from about 10 wt % to about 20 wt % polyaniline-based polymer. Such solution concentrations are comparable to those commercially available with xylene-based solvent systems.

If desired, the bicyclic terpene solvent of the invention can be used with other miscible solvents that may provide additional solvation for one or more other materials to be co-deposited with the polyaniline. One such example is N-ethylpyrrolidone that, while being a good solvent for acid-doped polyaniline, also has a sufficiently high dielectric constant to allow co-deposition of various salts.

The polyaniline polymer solution of the present invention is particularly suitable in the manufacture of capacitive elements that use an electrically conductive, acid-doped polyaniline polymer as an electrolyte. Such capacitive elements are made from valve metal powders that are anodized to form a dielectric layer on the surface of the anode body, coated with an electrically conductive polymer to form an electrolyte layer, reformed, coated/reformed until the desired electrolyte thickness is achieved, and finished. Liquid electrolytes are generally preferred for high voltage capacitive elements.

The valve metals from which the capacitive elements are formed preferably are made of materials that form an insulating film when the body is positively charged. When the body is negatively charged, the film will conduct. Suitable materials include the Group IV and V metals (particularly niobium, tantalum, zirconium, and titanium) and aluminum. When powdered, appropriate powder sizes are within the range of 0.05 to 50 microns. These powders are pressed with or without a binder to form a green anode body having a density of about 30–70% theoretical density. The green body is then sintered at a temperature within the range from about 1200° C. to about 1800° C. Aluminum is preferably used in the form of a foil or etched foil that is either rolled or stacked.

The anode is then "anodized" by suspending the sintered body in an electrolyte solution at a formation voltage of 3–4 times the rated voltage of the element. For example, a typical part rated at 10 volts would be formed at 30–40 volts, usually 35 volts. Suitable electrolyte solutions include phosphoric acid or ammonium nitrate in water with or without thickening agents, solvents, co-solvents, surfactants, or other conventional additives.

Once anodized, the anode is coated with one or more layers of an electrically conductive, acid-doped polyaniline-based polymer by immersing the capacitive element in a solution containing the polymer in the solvent. The coated element is then heated to drive off the solvent. Suitable heating temperatures are within the range from about 35° C. to about 120° C.

The polymer-coated capacitive element is then "reformed" by immersing the element in an acidic reforming solution. After heating, there may be residual monomer or by-product materials that are undesirable in the final capacitive element. Such materials are readily removed by washing with water, solvents, and/or surfactants. Preferred washing agents include methanol or acetone.

The thickness of the electrolyte layer can be increased by repeating the above process steps until an adequate thickness is achieved. In general, the polymeric coating can be built up with 1–20 repetitions of the impregnation, heating, and washing steps.

The reformed capacitive element is then finished to make a stock part. Finishing would typically entail an outer coating of the undoped solid electrolyte polymer, imprinting the element with an electrode pattern, sealing the unit in a nonconductive material, e.g., epoxy, and forming a multi-element assembly (if desired).

EXAMPLE

A film of DNSA-doped polyaniline polymer was formed from a solution containing xylene, ethylene glycol, and monobutyl ether. The film was removed from the substrate and contacted with a solvent of gum turpentine. The polyaniline solids were readily re-dissolved and would re-form a film of good integrity.

We claim:

1. A process for making capacitive elements including the steps of:

a. anodizing an anode body of sintered valve metal powder to form a dielectric surface layer; and b. coating the anode with an electrically conductive, solid electrolyte by applying to said dielectric surface layer a solution comprising an acid-doped polyaniline polymer dissolved in a solvent containing at least one bicyclic terpene.

2. A process according to claim 1 wherein said anode body is made of tantalum.

3. A process according to claim 1 wherein said acid-doped polyaniline polymer is a sulfonic acid-doped polyaniline polymer.

4. A process according to claim 3 wherein said acid-doped polyaniline polymer is a dinonyl naphthalene sulfonic acid-doped polyaniline polymer.

5. A process according to claim 1 further comprising:

washing the polymer coating with either methanol or acetone.

6. A process according to claim 1 wherein said solvent contains α-pinene.

7. A process according to claim 1 wherein said solvent also contains β-pinene.

8. A process according to claim 1 wherein said solvent contains gum turpentine.

9. A process according to claim 1 wherein said solvent consists essentially of gum turpentine.

10. A liquid solution containing:

at least one bicyclic terpene and an acid-doped polyaniline-based polymer.

11. A liquid solution according to claim 10 wherein said acid-doped polyaniline polymer is a sulfonic acid-doped polyaniline polymer.

12. A liquid solution according to claim 11 wherein said acid-doped polyaniline polymer is a dinonyl naphthalene sulfonic acid-doped polyaniline polymer.

13. A liquid solution according to claim 10 containing 0.01–35 wt % of said polymer.

14. A liquid solution according to claim 13 wherein said polymer is dinonyl naphthalene sulfonic acid-doped polyaniline.

15. A liquid solution according to claim 10 containing 10–20 wt % of said polymer.

16. A liquid solution according to claim 15 wherein said polymer is dinonyl naphthalene sulfonic acid-doped polyaniline.

17. A liquid solution according to claim 10 further comprising α-pinene.

18. A liquid solution according to claim 10 further comprising β-pinene.

19. A liquid solution according to claim 10 further comprising gum turpentine.

* * * * *